US009557759B2

(12) United States Patent
Kwon et al.

(10) Patent No.: US 9,557,759 B2
(45) Date of Patent: Jan. 31, 2017

(54) REFERENCE VOLTAGE GENERATOR

(71) Applicant: SAMSUNG ELECTRONICS CO., LTD., Suwon-si, Gyeonggi-do (KR)

(72) Inventors: Sunwoo Kwon, Seongnam-si (KR); Myung-Jin Lee, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 172 days.

(21) Appl. No.: 14/513,800

(22) Filed: Oct. 14, 2014

(65) Prior Publication Data

US 2015/0192946 A1 Jul. 9, 2015

(30) Foreign Application Priority Data

Jan. 9, 2014 (KR) ..... 10-2014-0003074

(51) Int. Cl.
*G05F 3/08* (2006.01)
*G05F 1/46* (2006.01)

(52) U.S. Cl.
CPC ..... *G05F 3/08* (2013.01); *G05F 1/468* (2013.01)

(58) Field of Classification Search
CPC ..... G06F 3/044; H03K 2217/960725; H03K 17/955; H03K 2217/96074; H03K 2217/960745; G05F 1/468; G05F 3/08; G05F 3/02; H02H 3/07; H02M 1/36; H02M 1/32
See application file for complete search history.

(56) References Cited

U.S. PATENT DOCUMENTS

| | | | | |
|---|---|---|---|---|
| 6,147,522 | A | 11/2000 | Rhode et al. | |
| 6,181,157 | B1 * | 1/2001 | Fiedler | H04L 25/0278 326/30 |
| 7,253,764 | B2 * | 8/2007 | Wang | H03M 1/66 341/143 |
| 7,456,769 | B2 | 11/2008 | Wang et al. | |
| 7,477,079 | B2 | 1/2009 | Gaboriau et al. | |
| 2004/0021506 | A1 | 2/2004 | Tanase | |
| 2005/0118980 | A1 * | 6/2005 | Pai | H03F 1/34 455/340 |
| 2009/0197552 | A1 | 8/2009 | Kurahashi et al. | |

OTHER PUBLICATIONS

P. Kurahashi et al., "Design of Low-Voltage Highly Linear Switched-R-MOSFET-C Filters", IEEE Journal of Solid-State Circuits, vol. 42, No. 8, Aug. 2007, pp. 1699-1709.

* cited by examiner

*Primary Examiner* — Adolf Berhane
*Assistant Examiner* — Henry Lee, III
(74) *Attorney, Agent, or Firm* — F. Chau & Associates, LLC

(57) ABSTRACT

A reference voltage generator including an electrostatic discharge (ESD) resistor, a first branch coupled to the ESD resistor and including a first capacitor, a second branch coupled to the ESD resistor and including a second capacitor, wherein the first and second capacitors are coupled in parallel, a first switch configured to control a first charge transfer path leading to the first branch, and a second switch configured to control a second charge transfer path leading to the second branch.

18 Claims, 12 Drawing Sheets

FIG. 1 - PRIOR ART
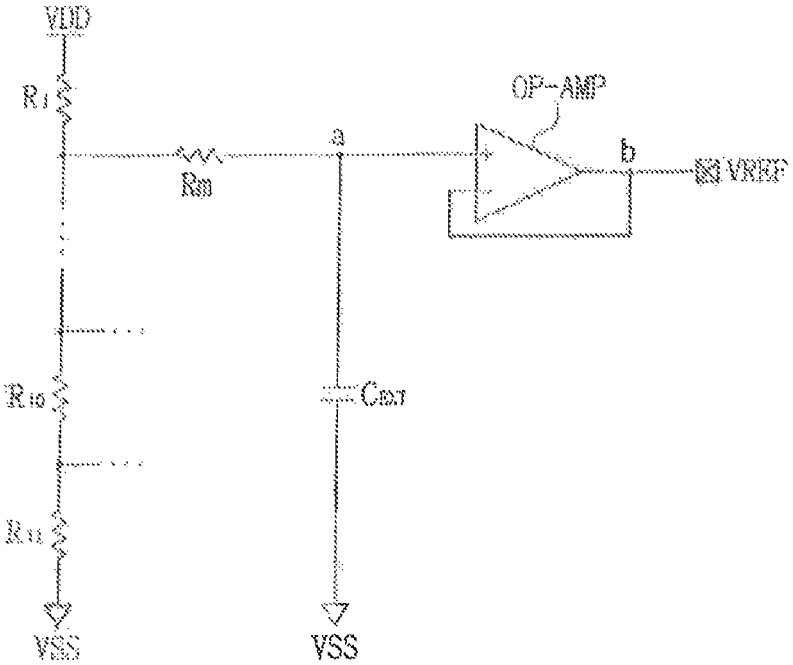
FIG. 2A - PRIOR ART
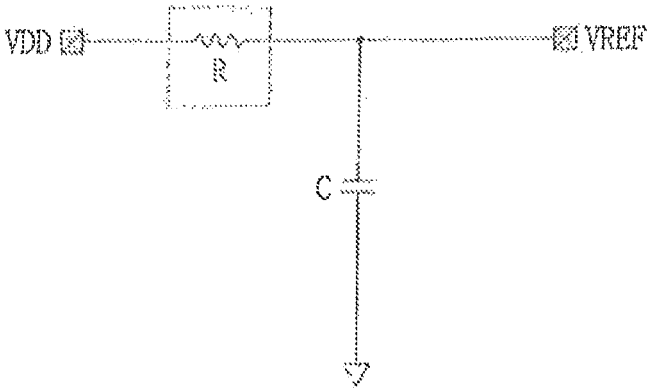

FIG. 2B - PRIOR ART
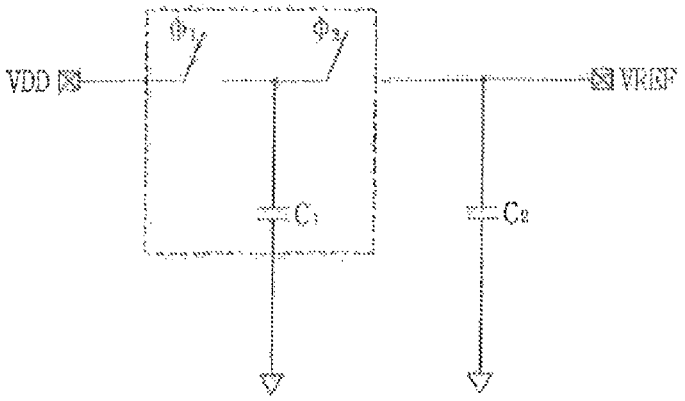
FIG. 2C - PRIOR ART
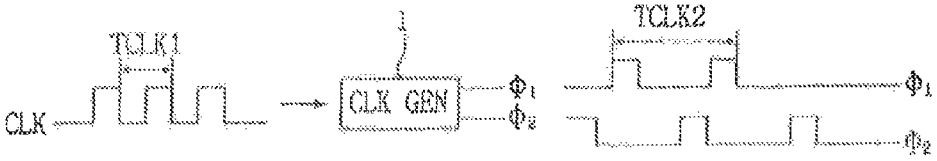

REFERENCE VOLTAGE GENERATOR

CROSS-REFERENCE TO RELATED APPLICATION

This application claims priority under 35 U.S.C. §119 to Korean Patent Application No. 10-2014-0003074 filed on Jan. 9, 2014, the disclosure of which is incorporated by reference herein in its entirety.

TECHNICAL FIELD

Exemplary embodiments of the inventive concept relate to a reference voltage generator, and more particularly, to a reference voltage generator which uses a switch for filtering.

DESCRIPTION OF RELATED ART

In general, an image sensor may include a pixel array having a matrix structure made up of a plurality of columns and a plurality of rows, and a converter for converting an output of the pixel array. In an example operation, the pixel array senses an optical image and outputs the sensed image as an analog voltage, and the converter converts the analog voltage into a digital value, and proceeds with a subsequent process.

In this case, the performance of the image sensor may be determined by how fast and precisely the converter converts the analog voltage into the digital value.

SUMMARY

Exemplary embodiments of the inventive concept provide a reference voltage generator having a filter capable of providing a desired cut off frequency in various frequency environments.

In accordance with an exemplary embodiment of the inventive concept, a reference voltage generator includes an electrostatic discharge (ESD) resistor, a first branch, a second branch, a first switch and a second switch. The first branch may be coupled to the ESD resistor and include a first capacitor. The second branch may be coupled to the ESD resistor and include a second capacitor. The first and second capacitors may be coupled in parallel. The first switch may be configured to control a first charge transfer path leading to the first branch. The second switch may be configured to control a second charge transfer path leading to the second branch.

In an exemplary embodiment of the inventive concept, the first switch may be controlled by a first clock signal and the second switch may be controlled by a second clock signal, wherein active intervals of the first and second clock signals do not overlap each other.

In an exemplary embodiment of the inventive concept, charges may be moved from the ESD resistor to the first capacitor by closing the first switch.

In an exemplary embodiment of the inventive concept, a charging time during which the charges move from the ESD resistor to the first capacitor may be controlled by adjusting an on-time of the first switch.

In an exemplary embodiment of the inventive concept, charges may be moved from the first capacitor to the second capacitor by closing the second switch.

In an exemplary embodiment of the inventive concept, a charging time during which the charges move from the first capacitor to the second capacitor may be controlled by adjusting an on-time of the second switch.

In an exemplary embodiment of the inventive concept, during a first time, the first switch may be turned on and the second switch may be turned off.

In an exemplary embodiment of the inventive concept, during a second time, the first switch may be turned off and the second switch may be turned on.

In accordance with an exemplary embodiment of the inventive concept, a reference voltage generator includes an ESD resistor, a first switch, a second switch, a first capacitor, and a second capacitor. The first switch may be configured to control a charge transfer path leading from the ESD resistor. The second switch may be connected to the first switch in series. The first capacitor may be provided between the first switch and the second switch and coupled in parallel to the first switch and the second switch. The second capacitor may be coupled to the first capacitor in parallel.

In an exemplary embodiment of the inventive concept, the first switch may be controlled by a first clock signal and the second switch may be controlled by a second clock signal, wherein active intervals of the first and second clock signals do not overlap each other.

In an exemplary embodiment of the inventive concept, the first capacitor may be a filtering capacitor.

In an exemplary embodiment of the inventive concept, a charging time during which charges move from the ESD resistor to the first capacitor may be controlled by adjusting an on-time of the first switch.

In an exemplary embodiment of the inventive concept, the second capacitor may be configured to accumulate charges to generate a reference voltage.

In an exemplary embodiment of the inventive concept, a charging time during which charges move from the first capacitor to the second capacitor may be controlled by adjusting an on-time of the second switch.

In an exemplary embodiment of the inventive concept, a third switch may be coupled between the second capacitor and an input terminal of an operational amplifier.

In accordance with an exemplary embodiment of the inventive concept, a reference voltage generator includes a first resistor having a first terminal connected to a power voltage; a first switch connected to a second terminal of the first resistor; a second switch connected in series to the first switch; a first capacitor having a first terminal connected between the first and second switches and a second terminal connected to a ground voltage; and a second capacitor having a first terminal connected to the second switch and a second terminal connected to an input of an operational amplifier, wherein the first and second switches are controlled by first and second clock signals, respectively.

In an exemplary embodiment of the inventive concept, a third switch may be connected to the first terminal of the first resistor and the first terminal of the second capacitor, wherein the third switch is controlled by a third clock signal.

In an exemplary embodiment of the inventive concept, a fourth switch may be connected to the second terminal of the second capacitor and first terminal of the second capacitor, wherein the fourth switch is controlled by the first clock signal.

In an exemplary embodiment of the inventive concept, active periods of the first, second and third clock signals may not overlap.

In an exemplary embodiment of the inventive concept, the reference voltage generator may be included in an analog-to-digital converter.

BRIEF DESCRIPTION OF THE DRAWINGS

The foregoing and other features of the inventive concept will become more apparent by describing in detail exemplary embodiments thereof with reference to the accompanying drawings. In the drawings:

FIG. 1 is a circuit diagram illustrating a reference voltage generator of an analog converter in a general image sensor;

FIG. 2A is an equivalent circuit diagram illustrating a general resistor-capacitor (R-C) filter;

FIG. 2B is a circuit diagram illustrating a reference voltage generator employing a general switched capacitor filter;

FIG. 2C is a timing diagram of FIG. 2B;

DETAILED DESCRIPTION OF THE EMBODIMENTS

Figure 3A:
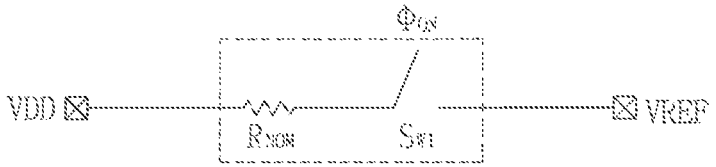
FIG. 3A is an equivalent circuit diagram illustrating a switched resistor in accordance with an exemplary embodiment of the inventive concept.

Exemplary embodiments of the inventive concept will now be described more fully with reference to the accompanying drawings. The inventive concept may, however, be embodied in different forms and should not be construed as limited to the embodiments set forth herein. In the drawings, the sizes and relative sizes of layers and regions may be exaggerated for clarity.

It will be understood that when an element or layer is referred to as being "on," "connected to," or "coupled to" another element or layer, it can be directly on, connected, or coupled to the other element or layer or intervening elements or layers may be present. Like numerals may refer to like elements throughout the specification and drawings.

As used herein, the singular forms "a," "an," and "the" are intended to include the plural forms as well, unless the context clearly indicates otherwise.

FIG. 1 is a diagram illustrating a circuit that generates a reference voltage for an analog converter in a general image sensor, in other words, a ladder type reference voltage generation circuit in which a voltage is divided by a plurality of resistors R1, . . . R10, and R11.

Referring to FIG. 1, the circuit includes the plurality of resistors R1, . . . R10, R11, and Rm, a capacitor $C_{EXT}$, and an operational amplifier OP-AMP.

The plurality of resistors R1, . . . , R10, R11, and Rm are coupled in series between an external power voltage VDD and a ground voltage VSS. A voltage applied to both ends of each node according to a distribution ratio between the resistances coupled to the both ends of each node is divided by a selected node. In the case of FIG. 1, the divided voltage is provided to a node a, and thus is applied to the operational amplifier OP-AMP.

The operational amplifier OP-AMP receives a voltage of the node a and a feedback voltage of a node b, to produce a reference voltage VREF.

To reduce signal noise, in other words, noise of the reference voltage VREF obtained in the above described general method, an R-C filter as a low pass filter frequency may be employed.

In FIG. 1, the resistor Rm and the capacitor $C_{EXT}$ are configured as the R-C filter to filter signal noise of a voltage divided by resistance to provide a reference voltage at a stable level having less noise. The R-C filter may be referred to as a resistor-capacitor circuit.

For example, the capacitor $C_{EXT}$ is coupled to the node a to provide a discharge path of noise, thereby attenuating a peak value of the node a. The capacitor $C_{EXT}$ may include a bypass capacitor or a decoupling capacitor.

A linear reference voltage may be provided in the form of digital data according to a resistance division ratio selected through a resistor network. As for the reference voltage generator including such a resistor network, the resistor Rm may be provided to have a relatively large resistance, and the capacitor $C_{EXT}$ may be provided to have a large capacitance.

FIG. 2A shows a general equivalent circuit diagram of an R-C filter.

Referring to FIG. 2A, a resistor R and a capacitor C are provided between an external voltage VDD and a reference voltage VREF.

According to an alternative example of the R-C filter, the resistor R may be replaced with a switch. In this way, a switched capacitor may be formed.

FIG. 2B is a circuit diagram illustrating a reference voltage generator adopting a general switched capacitor.

Referring to FIG. 2B, the reference voltage generator includes a first switch Φ1, a second switch Φ2, a first capacitor C1, and a second capacitor C2.

The switched capacitor circuit includes two parallel branches including the first switch Φ1 and the second switch Φ2, respectively, with the first and second switches Φ1 and Φ2 coupled to each other in series and operating by use of complementary signals. The first capacitor C1 is coupled between contacts of the switches Φ1 and Φ2 of the two branches (see the dotted block). The first switch Φ1 and the second switch Φ2 operate in a rotational manner such that the first capacitor C1 is periodically charged and discharged. Accordingly, the first switch Φ1 and the second switch Φ2 are open and closed (ON/OFF) in response to a clock frequency.

The clock signal is not implemented as an additional resource, but is implemented using a clock signal that is used for a data converter. In this case, additional resources may not be needed.

FIG. 2C is a timing diagram of FIG. 2B.

Referring to FIG. 2C a main dock CLK operates at a predetermined period TCLK1.

A clock generator 1 allows the first switch Φ1 and the second switch Φ2 to operate at respective different periods, and output signals whose active intervals do not overlap each other.

When such a switched capacitor filter is used, the switching operation with a clock produces a smaller resistance value when compared to a large resistance value of a resistor R of a conventional R-C filter.

The resistance value of the first switch Φ1 is expressed as Equation 1 below.

$$R_{EQ} = \frac{1}{f_{CLK} * C} \quad \text{[Equation 1]}$$

($R_{EQ}$ corresponds to effective resistance, $f_{CLK}$ is clock frequency, and C is capacitance).

The switched capacitor filter illustrated in FIGS. 2B and 2C is configured to provide a small resistance value, and the circuit is designed to be small in area.

However, even if the filter of FIGS. 2B and 2C is constructed to have a smaller resistance value than that of the R-C filter of FIG. 1, a cutoff filter frequency, which is dependent on a clock frequency, may also vary depending on a difference of a sampling ratio or an oversampling ratio.

For example, for a telephone with a sampling ratio of 8 kHz and a compact disc with a sampling ratio of 44.1 kHz, a stable cutoff filter frequency may not be easily provided. If a required cutoff filter frequency varies depending on a difference in sampling ratios of the applications, a proper range of filtering may not be easily set.

FIG. 3A is an equivalent circuit diagram illustrating a switched resistor in accordance with an exemplary embodiment of the inventive concept.

Referring to FIG. 3A, a resistor $R_{NOM}$ and a first switch SW1 are provided between an external voltage VDD and a reference voltage VREF.

The resistor $R_{NOM}$ may represent a nominal resistance that is generally provided in a circuit for electrostatic discharge (ESD), for example, an ESD resistor with a resistance value of 100Ω.

A clock signal $\Phi_{ON}$ is applied to the first switch SW1.

According to an exemplary embodiment of the inventive concept, the first switch SW1 configured to control the nominal resistance $R_{NOM}$ is provided to form a switched resistor, thereby tuning a resistance value. In other words, by use of the property of a switch performing an on/off operation, a resistor can be finely tuned.

Figure 3B:
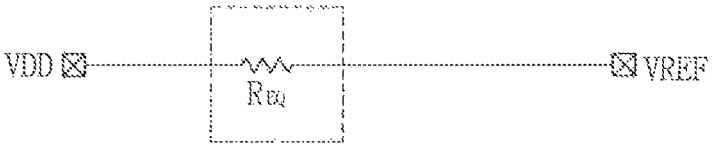
FIG. 3B is an equivalent circuit diagram of an effective resistance of FIG. 3A.
Figure 3C:
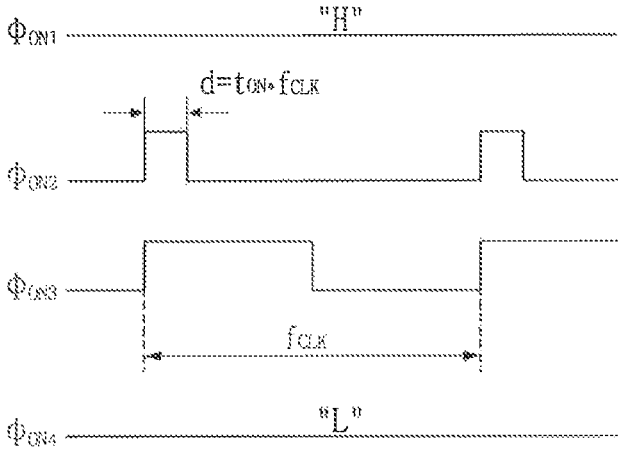
FIG. 3C is a timing diagram illustrating examples of various clock frequencies that are applied to a first switch SW1 of FIG. 3A.

FIG. 3B is an equivalent circuit diagram of an effective resistance of FIG. 3A, and FIG. 3C is a timing diagram illustrating examples of various clock frequencies that may be applied to the first switch SW1.

Referring to FIGS. 3A to 3C, the first switch SW1 may be subject to a switch on/off control according to various clocks having various duty ratios, and $R_{EQ}$ may increase/decrease depending on a duty ratio, and is expressed by Equation 2 below.

$$R_{EQ} = \frac{R_{NOM}}{d} = \frac{R_{NOM}}{t_{ON} * f_{CLK}} \quad \text{[Equation 2]}$$

($R_{EQ}$ corresponds to effective resistance, $R_{NOM}$ corresponds to ESD resistance, d is a duty ratio, $f_{CLK}$ is clock frequency, and $t_{ON}$ is an active interval).

For example, when the first switch SW1 is fully on, $\Phi_{ON1}$ illustrated in FIG. 3C is applied to Equation 2 and $$R_{EQ} = \frac{R_{NOM}}{1} = R_{NOM}.$$

In other words, when the first switch SW1 is fully on, the effective resistance $R_{EQ}$ becomes equal to the resistance value of the nominal resistance $R_{NOM}$.

When the first switch SW1 is fully off, $\Phi_{ON4}$ illustrated in FIG. 3C is applied to Equation 2, and $R_{EQ}$ becomes infinity.

In addition, the value of $R_{EQ}$ may be varied in practice according to various examples of duty ratios such as $\Phi_{ON2}$ and $\Phi_{ON3}$ illustrated in FIG. 3C.

As described above, using the property of the switched resistor, the resistance value of $R_{EQ}$ may be provided to be varied in practice through on/off time control of the switch. At the same time, since an existing resistor for ESD is used, the physical area of a circuit, in other words, the layout size may be kept small. Accordingly, when the switched resistor in accordance with an exemplary embodiment of the inventive concept is used, the resistance value may be easily controlled while requiring a small area. Therefore, circuit designers may set the range of cutoff filter frequencies not only by controlling clock frequency ($f_{CLK}$) variables but also duty ratio (d) variables, thereby improving design flexibility.

In other words, even when the external environment of sampling frequencies is changed, a circuit having a constant cutoff frequency may be implemented by controlling the duty ratio.

In addition, since an ESD resistor provided in a general circuit is used without having to add new physical resources, additional processes and costs may not be incurred.

Figure 3D:
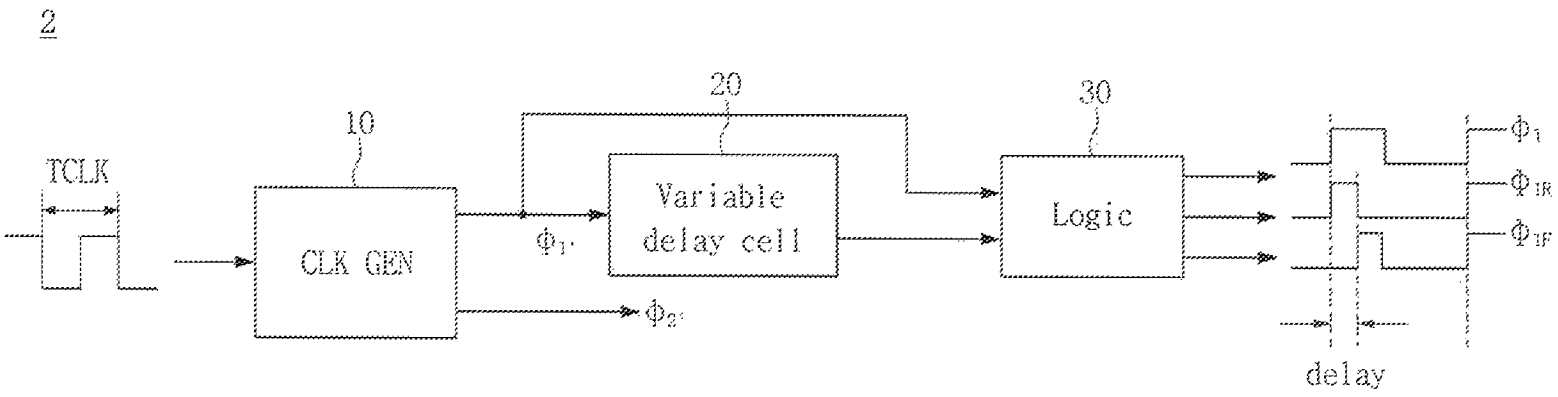
FIG. 3D is a block diagram illustrating generation of clocks having various duty ratios of FIG. 3C.

FIG. 3D is a block diagram illustrating generation of clocks having various duty ratios of FIG. 3C.

Referring to FIG. 3D, a clock modulation circuit 2 in accordance with an exemplary embodiment of the inventive concept may include a clock generator 10, a delay cell 20, and a logic circuit 30.

The clock generator 10 receives a clock CLK having a predetermined period TCLK, and generates complementary signals Φ1' and Φ2' whose active intervals do not overlap each other, and provides one Φ1' of the signals Φ1' and Φ2' to the delay cell 20.

The delay cell 20 may change the period of a clock by allowing the received signal Φ1' to pass through a delay chain having various amounts of delayed time.

The logic circuit 30 combines the signal Φ1' from the clock generator 10 with logic statuses of output clocks from the delay cell 20, thereby providing various clock signals having different amounts of delayed time, for example, Φ1, Φ1R, and Φ1F.

Although the above description is made to provide an example of generating clock signals having various periods by varying the amount of delay, the inventive concept is not limited thereto, and it will be understood that various modifications can be made to the clock modulation circuit.

In other words, in accordance with an exemplary embodiment of the inventive concept, a filter circuit may be constructed by use of the switched resistor as illustrated in FIG. 3A, and clock signals for controlling the filter circuit having various periods may be devised. Hereinafter, this will be described in detail with reference to the accompanying drawings.

Figure 4A:
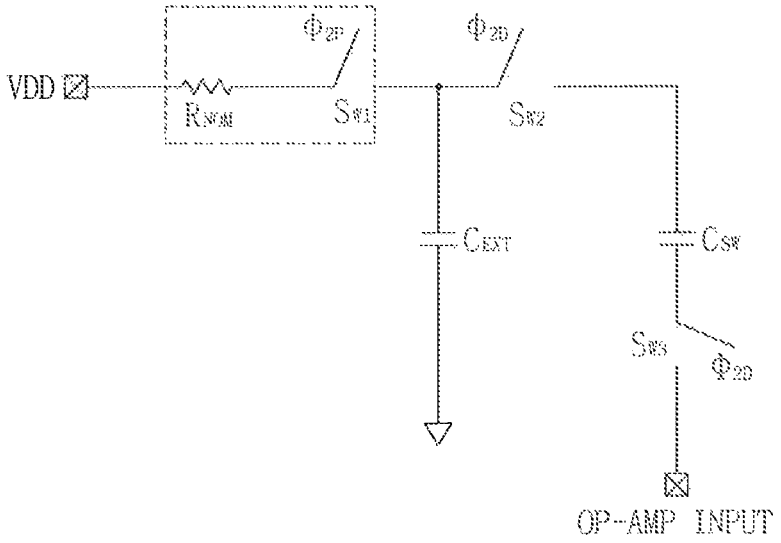
FIG. 4A is a circuit diagram illustrating a reference voltage generator adopting a switched resistor-capacitor filter in accordance with an exemplary embodiment of the inventive concept.

FIG. 4A is a circuit diagram illustrating a reference voltage generator adopting a switched resistor-capacitor filter in accordance with an exemplary embodiment of the inventive concept.

Although the reference voltage generator has an input part thereof illustrated at the last end of the circuit diagram of FIG. 4A, it should be understood that a final reference voltage is generated via an operational amplifier that follows the input part.

Referring to FIG. 4A, the reference voltage generator circuit includes a nominal resistance $R_{NOM}$, a first switch SW1, a second switch SW2, a third switch SW3, a first capacitor $C_{EXT}$, and a second capacitor $C_{SW}$.

The reference voltage generator circuit employing the switched resistor-capacitor filter includes two parallel branches including the first switch SW1 and the second switch SW2, respectively, wherein the first and second switches SW1 and SW2 are coupled in series and operate by use of clock signals Φ2P and Φ2D, respectively, whose active intervals do not overlap each other.

The first capacitor $C_{EXT}$ is coupled between contacts of the switches SW1 and SW2 of the two branches.

The second capacitor $C_{SW}$ is provided between the second switch SW2 and the third switch SW3.

The first switch SW1 may periodically provide or block a path of the nominal resistance $R_{NOM}$ in response to the clock signal Φ2P. The first switch SW1 may provide a charging path leading from the external voltage VDD to the first capacitor $C_{EXT}$.

In addition, charges stored in the first capacitor $C_{EXT}$ may be transmitted by the second switch SW2 to the second capacitor $C_{SW}$.

The second and third switches SW2 and SW3 may be simultaneously controlled by the same clock signal, for example, Φ2D.

In FIG. 4A, the part illustrated as a dotted line may operate as a switched resistor, and the charging timing of the first capacitor $C_{EXT}$ may be controlled according to the switched resistor. Accordingly, the first switch SW1 operates as a resistance switch, and the second switch SW2 may operate as a capacitor switch, in other words, a switch for the second capacitor $C_{SW}$.

In other words, the nominal resistance $R_{NOM}$, the first switch SW1, and the first capacitor $C_{EXT}$ may be referred as a switched resistor-capacitor filter circuit, and by further adding the second switch SW2, the second capacitor $C_{SW}$, and the third switch SW3 to the switched resistor-capacitor filter circuit, the reference voltage generator may be formed.

Figure 4B:
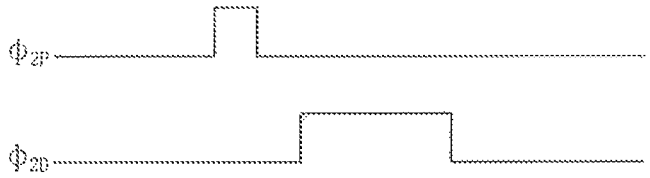
FIG. 4B is a timing diagram illustrating an operation of FIG. 4A.

FIG. 4B is a timing diagram illustrating an operation of FIG. 4A.

Referring to FIGS. 4A and 4B, first, the clock signal Φ2P is activated prior to the clock signal Φ2D during a predetermined interval. During the active interval of the clock signal Φ2P, the first switch SW1 may provide a charging path leading from the external voltage VDD to the first capacitor $C_{EXT}$.

Thereafter, in response to the clock signal Φ2D, the second switch SW2 is turned on so that charges stored in the first capacitor $C_{EXT}$ are transferred to pass through the second capacitor $C_{SW}$, thereby providing a reference voltage VREF having a reduced noise component.

As described above, a filter circuit is provided as a switched resistor-capacitor having a switch not only at a capacitor but also at an ESD resistor in accordance with an exemplary embodiment of the inventive concept, thus achieving design flexibility and constant frequency cutoff features.

Figure 5:
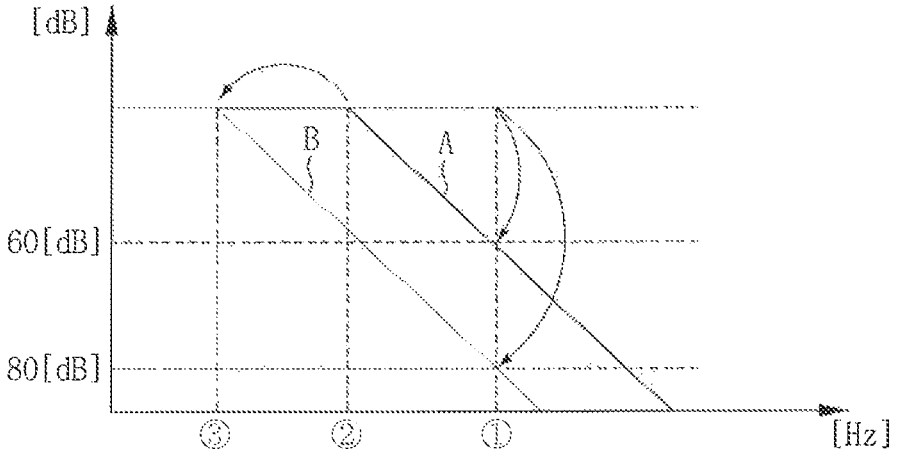
FIG. 5 is a graph showing a comparison of frequency response characteristics of an experimental example of an exemplary embodiment of the inventive concept and a conventional example.

FIG. 5 is a graph showing a frequency response characteristic of an experimental example of an exemplary embodiment of the inventive concept compared with that of a conventional example.

The frequency response characteristic is provided to measure a response when input signals of various frequencies are input, and is expressed as a frequency response characteristic curve of a low pass filter as shown in the graph of FIG. 5.

Referring to FIG. 5, the X-axis represents frequency (Hz), and the Y axis represents a decibel scale (dB), dB of the Y axis represents a relative value expressing a numerical relation. An exemplary embodiment of the inventive concept uses the decibel scale that has a characteristic of being proportional to a log scale with respect to a power of magnitude of a frequency signal and is easily expressed.

Graph A shows an experimental example using a conventional switched capacitor, and Graph B shows an experimental example using the switched resistor-capacitor in accordance with an exemplary embodiment of the inventive concept.

Referring to FIG. 5, with respect to the same frequency band (①), the cutoff magnitude of a signal for the example B is increased when compared to the conventional example A (60 dB–>80 dB). In addition, a predetermined frequency band, for example, a cutoff frequency is decreased (②–>③).

Here, the cutoff frequency, in other words, a filter frequency, refers to a frequency serving as a boundary between a pass band and a cutoff hand in a filter, at which the output amplitude of a filter is attenuated by ½ of the input amplitude of the filter, for example, by 3 dB. As described above, when the cutoff frequency is lowered, the magnitude of frequency to be filtered is increased and thus the filtering effect is enhanced.

Figure 6A:
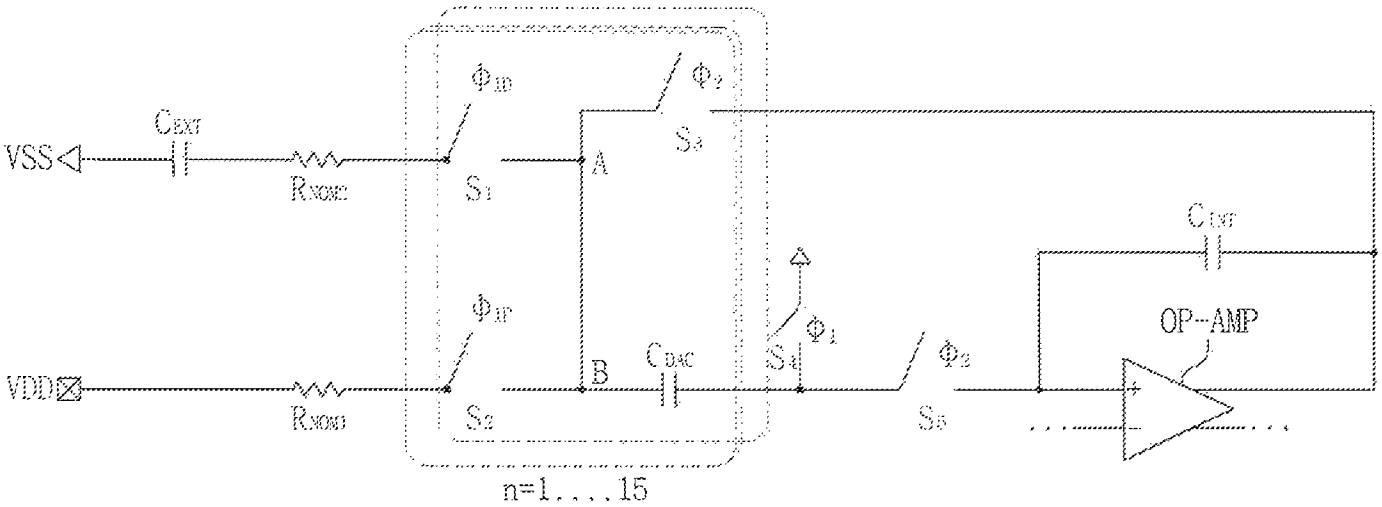
FIG. 6A is a ΣΔ (sigma delta) modulation circuit diagram adopting a switched resistor-capacitor filter in accordance with an exemplary embodiment of the inventive concept.

FIG. 6A is a ΣΔ (sigma delta) modulation circuit diagram adopting a switched resistor-capacitor filter in accordance with an exemplary embodiment of the inventive concept.

The ΣΔ modulation circuit may be used in various applications, including a digital-to-analog converter (DAC), an oversampling analog-to-digital converter (ADC), and a measurement digital-to-analog converter. In accordance with an exemplary embodiment of the inventive concept, an analog-to-digital converter circuit in an image sensor is illustrated as the ΣΔ modulation circuit. The ΣΔ modulation circuit is configured to receive a digital input having a resolution in plural bits (for example, 16 bits) at a low input sampling rate, and generate a digital output by use of one or a predetermined number of bits at a high output sampling rate while maintaining the same resolution.

Figure 6B:
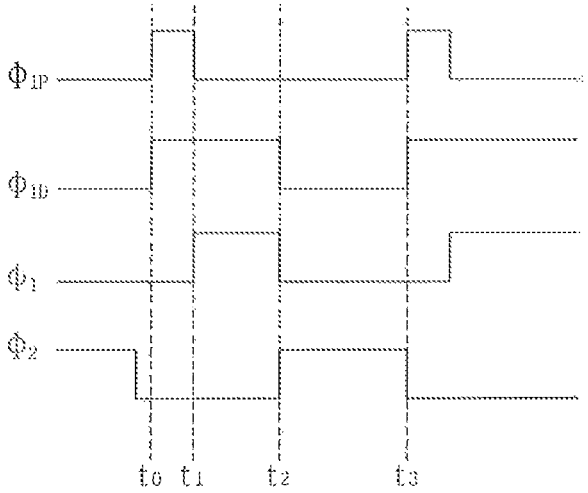
FIG. 6B is a timing diagram illustrating an operation of FIG. 6A.

FIG. 6B is a timing diagram illustrating an operation of FIG. 6A.

Hereinafter, an operation of the ΣΔ modulation circuit will be described with reference to FIGS. 6A and 6B in detail.

Referring to FIGS. 6A and 6B, the ΣΔ modulation circuit includes a first nominal resistance $R_{NOM1}$, a second nominal resistance $R_{NOM2}$, first to fifth switches S1 to S5, a first capacitor $C_{EXT}$, a second capacitor $C_{DAC}$, a third capacitor $C_{INT}$, and a comparison operational amplifier OP-AMP.

The ΣΔ modulation circuit of FIG. 6A is configured to receive 4 bit signals and provide a 16 level resolution.

Referring to FIG. 6A, when the switches S1 to S3 and the second capacitor $C_{DAC}$ constructed within a dotted line block are assumed as a single DAC-related element and the DAC element is provided in the total of 15 sets, the level to be expressed varies depending on how many DAC elements are activated.

For example, when all sets of the DAC elements are inactivated, a status of 0 is expressed, and when all sets of the DAC elements are activated, a status of 15 is expressed and thus 16 statuses are provided in total. However, this is provided only as an example, and the number of input hits in accordance with an exemplary embodiment of the inventive concept is not limited thereto.

The first capacitor $C_{EXT}$ is provided between the ground power VSS and the second nominal resistance $R_{NOM2}$ while having one end coupled to the ground power VSS and the other end coupled to the second nominal resistance $R_{NOM2}$.

The first nominal resistance $R_{NOM1}$ is provided between the external power VDD and the second switch $S_2$ while having one end coupled to the external power VDD and the other end coupled to the second switch $S_2$.

The first switch S1 and the second switch S2 are disposed in parallel to each other.

One end of the second capacitor $C_{DAC}$ is coupled to the second switch S2, and the other end of the second capacitor $C_{DAC}$ is coupled to the fourth switch S4.

One end of the third switch S3 is coupled to the first switch S1 and the other end of the third switch S3 is coupled to the third capacitor $C_{INT}$.

One end of the fifth switch S5 is coupled to the fourth switch S4, and the other end of the fifth switch S5 is coupled to an input of the comparison operational amplifier OP-AMP.

One end of the third capacitor $C_{INT}$ is coupled to an input of the comparison operational amplifier OP-AMP, and the other end of the third capacitor $C_{INT}$ is coupled to the third switch S3.

In addition, the switches S1 to S5 are controlled by respective control signals (e.g., clock signals).

In response to logic high levels of respective control signals, a switched resistor and a switched capacitor are implemented, thereby enabling adjustment of the filtering frequency of the ΣΔ modulation circuit.

For example, when a clock signal Φ1P which is activated at t0, is applied to the second switch S2, a switched resistor is implemented. An external voltage is applied through the second switch S2 during a predetermined period of time.

In addition, a clock signal Φ1D is applied to the first switch S1 at t0. As described above, the nominal resistances are resistors for ESD that are generally provided on a circuit, and as these resistors are controlled by the switches in accordance with an exemplary embodiment of the inventive concept, a switched resistor-capacitor filter is implemented, and an effective resistance value may be finely timed while controlling duty ratios.

In more detail, during an active interval of the clock signal Φ1D, the external voltage VDD is filtered by the first switch S1, the second nominal resistance $R_{NOM2}$, and the first capacitor $C_{EXT}$ and then is provided to nodes A and B. In this manner, noise is removed from the external voltage VDD, so that a more stable voltage is provided.

Thereafter, a clock signal Φ1, which is activated at t1, is applied to the fourth switch S4. Referring to FIG. 6B, by activating the clock signal Φ1 during the active interval of the clock signal Φ1D, the filtered external voltage VDD is charged in the second capacitor $C_{DAC}$.

After the charging is completed, a clock signal Φ2, which is activated at t2, is applied to the third switch S3 and the filth switch S5.

In this manner, a stable voltage is input into the comparison operational amplifier OP-AMP. It is to be understood that the third capacitor $C_{INT}$ is a capacitor for integration of the ΣΔ modulation circuit; however, the inventive concept is not limited to the integration capacitor.

In addition, the remaining input terminals of the comparison operational amplifier OP-AMP may be coupled to ground voltages depending on the construction of a circuit in which it is implemented, or a feedback loop circuit may be provided by using an integration capacitor having the above construction.

The ΣΔ modulation circuit provides an output value of the comparison operational amplifier OP-AMP, in other words, a reference voltage through a pattern including charging/pre-charging or transmission by transporting charges, thereby performing a data conversion operation. Here, the above description has been illustrated on a switched resistor-capacitor filter configured to remove noise such that a voltage serving as an input into the comparison operational amplifier OP-AMP is stabilized. Accordingly, rather than an unstable reference voltage that may cause a negative influence on a digital-to-analog converter, a stable reference voltage with removed noise is provided so that the performance of the digital-to-analog converter can be improved. For example, an exemplary embodiment of the inventive concept can ensure a fixed 3-dB frequency cutoff property, in particular, flexibility is achieved in coping with a frequency environment of various applications. This is achieved by using a switched resistor-capacitor filter and controlling the duty ratio of an on/off time of the switched switch. For example, by controlling an active interval of the clock signal Φ1D, flexibility is achieved in coping with a frequency environment of various applications.

In addition, without using an additional resistor, a nominal resistance (e.g., a resistor for ESD) that generally exists in a circuit is used, and thus, a space and cost for constructing an additional circuit are saved.

Hereinafter, a switched resistor-capacitor filter, which may diminish voltage droop, will be described in accordance with an exemplary embodiment of the inventive concept.

Figure 7A:
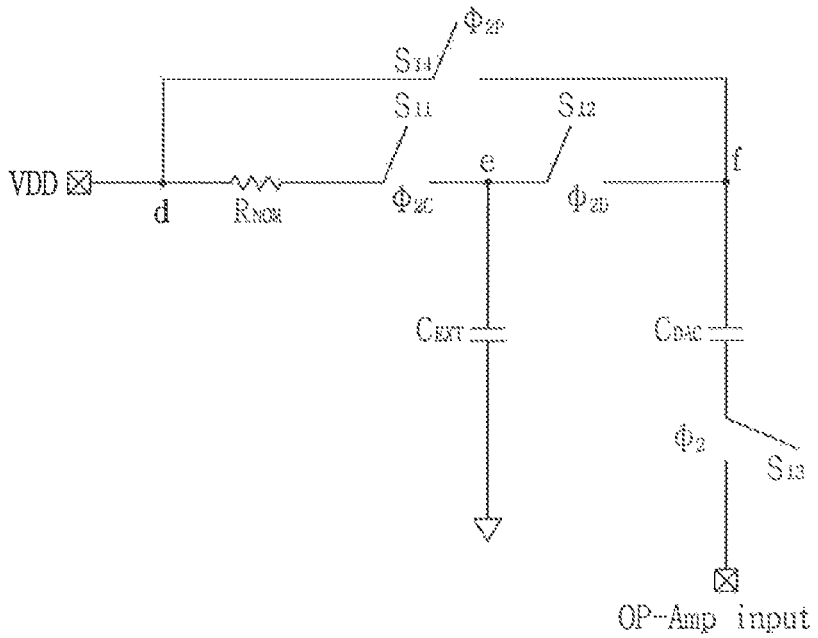
FIG. 7A is a circuit diagram illustrating a reference voltage generator according to an exemplary embodiment of the inventive concept.
Figure 7B:
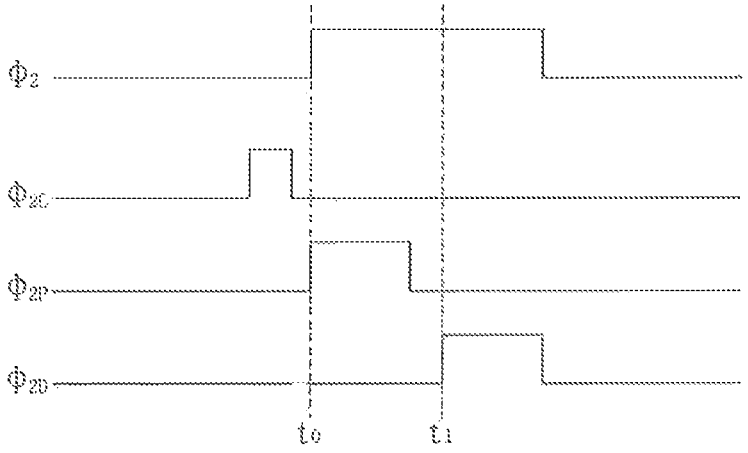
FIG. 7B is a timing diagram illustrating an operation of FIG. 7A.

FIG. 7A is a circuit diagram illustrating a switched resistor-capacitor filter according to an exemplary embodiment of the inventive concept, and FIG. 7B is a timing diagram illustrating an operation of FIG. 7A.

Different from FIG. 4A, the circuit illustrated in FIG. 7A has a switch S14 between an input terminal (VDD) and an output terminal (OP-AMP input).

Referring to FIG. 7A, the circuit includes a nominal resistance $R_{NOM}$, a first switch S11, a second switch S12, a third switch S13, a fourth switch S14, a first capacitor $C_{EXT}$, and a second capacitor $C_{DAC}$.

The switched resistor-capacitor circuit includes two parallel branches including the first switch S11 and the second switch S12, respectively, wherein the first and second switches S11 and S12 are coupled in series and operate by use of two clock signals Φ2C and Φ2D, respectively, whose active intervals do not overlap each other.

The first capacitor $C_{EXT}$ is coupled to a node e between the switches S11 and S12 of the two branches.

The second capacitor $C_{DAC}$ is provided between the second and third switches S12 and S13.

The first switch S11 is configured to periodically provide or block a path of the nominal resistance $R_{NOM}$ in response to the clock signal Φ2C.

The first switch S11 provides a charging path leading from the external voltage VDD to the first capacitor $C_{EXT}$.

In addition, charges stored in the first capacitor $C_{EXT}$ may be transmitted by the second switch S12 to the second capacitor $C_{DAC}$.

The clock signal Φ2D is applied to the second switch S12, and a clock signal Φ2 is applied to the third switch S13.

Referring to FIGS. 7A and 7B, the clock signal Φ2C is activated prior to t0 during a predetermined period of time. The external voltage VDD is pre-charged in the first capacitor $C_{EXT}$ by passing through the node e. The external voltage VDD filtered by the first switch S11, the nominal resistance $R_{NOM}$, and the first capacitor $C_{EXT}$ is pre-charged in the first capacitor $C_{EXT}$.

When the clock signal Φ2 is activated at t0, the clock signal Φ2P is activated during a predetermined period of time in synchronization with the clock signal Φ2. Accordingly, the voltage of a node d is transmitted to a node f through the fourth switch S14. The voltage substantially corresponds to an equal amount of charges charged in the first capacitor $C_{EXT}$. Charges are transported to the node f such that the node f is sufficiently pre-charged with a voltage as much as the charges charged in the first capacitor $C_{EXT}$.

Thereafter, when the clock signal Φ2D is activated at t1, the second switch S12 is turned on, and a current path to the second capacitor $C_{DAC}$ is provided. Accordingly, the second capacitor $C_{DAC}$ is charged with all of the electric charges pre-charged in the nodes e and f.

In accordance with an exemplary embodiment of the inventive concept illustrated in FIG. 7A, the node f gets pre-charged by the same voltage that has been pre-charged in the node e, thereby reducing a voltage droop in which a loss in the amount of charges gradually arises due to a load.

In other words, even if a predetermined amount of charges is charged in the node e and the first capacitor $C_{EXT}$, a loss in charges may occur since the second capacitor $C_{DAC}$ serves as a great load. In other words, some charges may be lost when a predetermined amount of charges having been charged in the node e and the first capacitor $C_{EXT}$ are transmitted to the second capacitor $C_{DAC}$ through the node f, which may result in a voltage drop due to a loss in charges over time. However, in accordance with an exemplary embodiment of the inventive concept, the node f is also pre-charged, no that the second capacitor $C_{DAC}$ is charged as much as a desired target amount.

The following description will be made in relation to a switched resistor-capacitor circuit, which may improve the linearity of an output signal of a target capacitor, in accordance with another exemplary embodiment of the inventive concept.

Figure 8A:
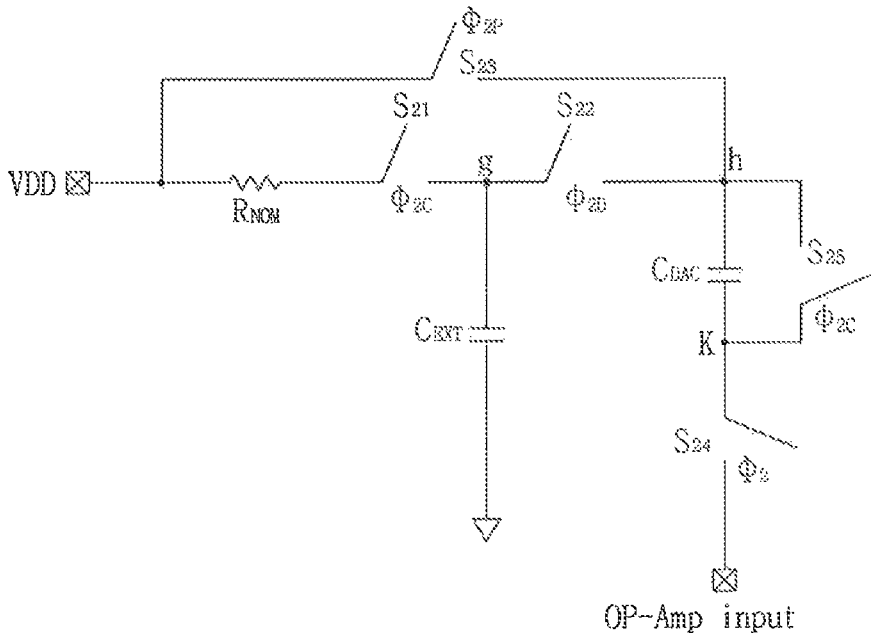
FIG. 8A is a circuit diagram of a reference voltage generator according to an exemplary embodiment of the inventive concept.
Figure 8B:
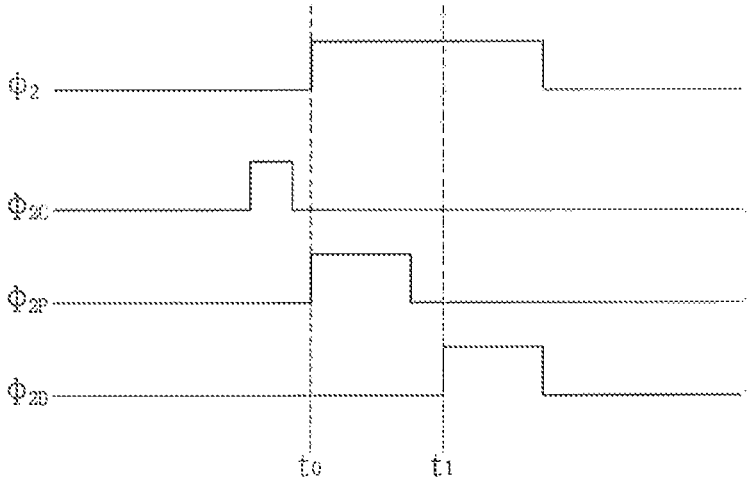
FIG. 8B is a timing diagram illustrating an operation of FIG. 8A.

FIG. 8A illustrates a switched resistor-capacitor circuit according to an exemplary embodiment of the inventive concept. The switched resistor-capacitor circuit of FIG. 8A operates in the same way as that of FIG. 7A except for resetting the second capacitor $C_{DAC}$. FIG. 8B is a timing diagram illustrating an operation of FIG. 8A.

The following description will be made mostly with reference to parts different from those illustrated in FIG. 7A while omitting certain details of parts identical to those illustrated in FIG. 7A.

Referring to FIG. 8A, the switched resistor-capacitor filter includes a nominal resistance $R_{NOM}$, a first switch S21, a second switch S22, a third switch S23, a fourth switch S24, a fifth switch S25, a first capacitor $C_{EXT}$, and a second capacitor $C_{DAC}$.

Referring to FIG. 8A, the second capacitor $C_{DAC}$ has one end coupled to a node h and the other end coupled to the fifth switch S25. The fifth switch S25 is a switch controlled by a clock signal Φ2C.

Accordingly, upon receiving a new signal, the second capacitor $C_{DAC}$ having been charged with a previous signal is controlled to be reset by use of the clock signal Φ2C.

Referring to FIGS. 8A and 8B, the clock signal Φ2C is activated during a predetermined period of time prior to t0. The external voltage VDD is charged in the first capacitor $C_{EXT}$ via a node g during the predetermined period of time. In this case, the charge level charged in the node g is substantially identical to the amount of charges charged in the first capacitor $C_{EXT}$.

The external voltage VDD filtered by the first switch S21, the nominal resistance $R_{NOM}$, and the first capacitor $C_{EXT}$ is pre-charged in the first capacitor $C_{EXT}$.

In addition, during the period of time when the clock signal Φ2C is activated, the second capacitor $C_{DAC}$ is charged with a voltage of the node h. Since the node h has been discharged in a previous stage, the second capacitor $C_{DAC}$ is substantially reset during the period of time when the clock signal Φ2C is activated.

In other words, to improve the linearity of an output voltage of the second capacitor $C_{DAC}$ upon iterative charging of the second capacitor $C_{DAC}$, the influence of previously received signals may be diminished or minimized. To this end, the second capacitor $C_{DAC}$ is reset before being charged with a newly received signal, to diminish the influence of the previous signal. Accordingly, a voltage having further reduced signal noise is provided.

Similar to FIGS. 7A and 7B, when the clock signal Φ2 is activated at t0, the clock signal Φ2P is activated in synchronization with the clock signal Φ2 during a predetermined period of time. Accordingly, the voltage of a node k is transmitted to the node h. In this case, the voltage transmitted to the node h substantially corresponds to the same amount of charges charged in the first capacitor $C_{EXT}$. In this case, the third switch S23 is at an on state, and thus a current path connecting the node k, the node h, and the third switch S23 is provided. Accordingly, the same amount of charges as that charged in the first capacitor $C_{EXT}$ are transported to the node h so that the node h is pre-charged.

Thereafter, when a clock signal Φ2D is activated at t1, the second switch S22 is turned on and a current path to the second capacitor $C_{DAC}$ is provided. Accordingly, the second capacitor $C_{DAC}$ is charged with all of the electric charges pre-charged in the nodes g and h.

Accordingly, in accordance with this exemplary embodiment of the inventive concept, the second capacitor $C_{DAC}$, which represents a target capacitor, is reset at each operation to minimize the influence of a previous signal on the second capacitor $C_{DAC}$, thereby increasing the linearity of the output signal of the second capacitor $C_{DAC}$. In other words, the output signal of the second capacitor $C_{DAC}$ is prevented from being distorted due to the influence of a previous signal, thereby enhancing the signal-to-noise ratio (SNR) efficiency of a reference voltage of an analog-to-digital converter that represents a final output.

It will be understood that the above description has been provided to disclose various examples using the switched resistor-capacitor filter, and does not limit the scope of the inventive concept.

Figure 9:
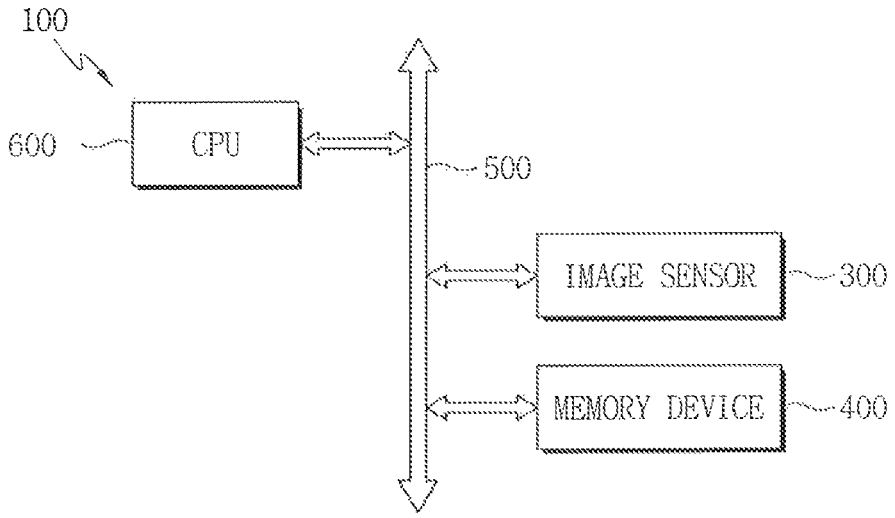
FIG. 9 is a schematic block diagram illustrating a semiconductor system including an image sensor including, an analog-to-digital converter provided with a switched resistor capacitor in accordance with an exemplary embodiment of the inventive concept.

FIG. 9 is a schematic block diagram illustrating a semiconductor system 100 including an image sensor 300 including an analog-to-digital converter provided with a switched resistor-capacitor in accordance with an exemplary embodiment of the inventive concept.

Referring to FIG. 9, the semiconductor system 100 may include an image sensor 300, a memory device 400, a bus 500, and a CPU 600.

The semiconductor system 100 may include a computer system, a camera system, a scanner, a navigation system, a video phone, a supervision system, an automatic focus system, a tracing system, an operation monitoring system, and an image stabilization system.

The CPU 600 may control operations of the image sensor 300 by transmitting and receiving data through the bus 500.

The memory device 400 may receive an image signal output from the image sensor 300 through the bus 500, and store the received image signal.

The semiconductor system 100 may further include an input output (IO) interface to communicate with the outside or a digital signal processor (DSP), for example.

The reference voltage generator in accordance with an exemplary embodiment of the inventive concept is provided with a switched resistor-capacitor filter that is formed by allowing a nominal resistance for ESD to be controlled by a switch. Accordingly, stable cutoff frequency effects can be provided in various frequency environments by controlling an on-time of the switch.

An exemplary embodiment of the inventive concept can be applied to a memory device, and particularly to an image sensor and a memory system including the same.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims.

What is claimed is:

1. A reference voltage generator, comprising:
an electrostatic discharge (ESD) resistor;
a first branch coupled to the ESD resistor and including a first capacitor;
a second branch coupled to the ESD resistor and including a second capacitor, wherein the first and second capacitors are coupled in parallel;
a first switch configured to control a first charge transfer path leading to the first branch; and
a second switch configured to control a second charge transfer path leading to the second branch,
wherein the first switch is controlled by a first clock signal and the second switch is controlled by a second clock signal,
wherein at least one of frequency and duty ratio of the first clock signal is changed for tuning a resistance value of the ESD resistor.

2. The reference voltage generator according to claim 1, wherein active intervals of the first and second clock signals do not overlap each other.

3. The reference voltage generator according to claim 1, wherein charges are moved from the ESD resistor to the first capacitor by closing the first switch.

4. The reference voltage generator according to claim 3, wherein a charging time during which the charges move from the ESD resistor to the first capacitor is controlled by adjusting an on-time of the first switch.

5. The reference voltage generator according to claim 1, wherein charges are moved from the first capacitor to the second capacitor by closing the second switch.

6. The reference voltage generator according to claim 5, wherein a charging time during which the charges move from the first capacitor to the second capacitor is controlled by adjusting an on-time of the second switch.

7. The reference voltage generator according to claim 2, wherein during a first time, the first switch is turned on and the second switch is turned off.

8. The reference voltage generator according to claim 7, wherein during a second time, the first switch is turned off and the second switch is turned on.

9. A reference voltage generator, comprising:
an electrostatic discharge (ESD) resistor;
a first switch configured to control a charge transfer path leading from the ESD resistor;
a second switch connected to the first switch in series;
a first capacitor provided between the first switch and the second switch and coupled in parallel to the first switch and the second switch; and
a second capacitor coupled to the first capacitor in parallel,
wherein the first switch is controlled by a first clock signal and the second switch is controlled by a second clock signal,
wherein at least one of frequency and duty ratio of the first clock signal is changed for tuning a resistance value of the ESD resistor.

10. The reference voltage generator according to claim 9, wherein active intervals of the first and second clock signals do not overlap each other.

11. The reference voltage generator according to claim 9, wherein the first capacitor is a filtering capacitor.

12. The reference voltage generator according to claim 11, wherein a charging time during which charges move from the ESD resistor to the first capacitor is controlled by adjusting an on-time of the first switch.

13. The reference voltage generator according to claim 9, wherein the second capacitor is configured to accumulate charges to generate a reference voltage.

14. The reference voltage generator according to claim 13, wherein a charging time during which charges move from the first capacitor to the second capacitor is controlled by adjusting an on-time of the second switch.

15. The reference voltage generator according to claim 9, further comprising a fourth switch coupled between the second capacitor and an input terminal of an operational amplifier.

16. A reference voltage generator, comprising:
a first resistor having a first terminal connected to a power voltage;
a first switch connected to a second terminal of the first resistor;
a second switch connected in series to the first switch;
a first capacitor having a first terminal connected between the first and second switches and a second terminal connected to a ground voltage;
a second capacitor having a first terminal connected to the second switch and a second terminal connected to an input of an operational amplifier, wherein the first and second switches are controlled by first and second clock signals, respectively;
a third switch connected to the first terminal of the first resistor and the first terminal of the second capacitor, wherein the third switch is controlled by a third clock signal; and a fourth switch connected to the second terminal of the second capacitor, wherein the fourth switch is controlled by the first clock signal.

17. The reference voltage generator according to claim 16, wherein active periods of the first, second and third clock signals do not overlap.

18. The reference voltage generator according to claim 16, wherein the reference voltage generator is included in an analog-to-digital converter.

* * * * *